US008398788B2

(12) United States Patent
Sheinkman et al.

(10) Patent No.: US 8,398,788 B2
(45) Date of Patent: Mar. 19, 2013

(54) METHODS OF PREPARING THIN POLYMETAL DIFFUSION COATINGS

(75) Inventors: Avraham Sheinkman, Ariel (IL); Itzhac Rozenthul, Ariel (IL); Ilana Diskin, Ariel (IL)

(73) Assignee: Greenkote Ltd, Barkan (IL)

( * ) Notice: Subject to any disclaimer, the term of this patent is extended or adjusted under 35 U.S.C. 154(b) by 317 days.

(21) Appl. No.: 12/524,884

(22) PCT Filed: Jan. 29, 2008

(86) PCT No.: PCT/IL2008/000125

§ 371 (c)(1),
(2), (4) Date: May 6, 2010

(87) PCT Pub. No.: WO2008/093335

PCT Pub. Date: Aug. 7, 2008

(65) Prior Publication Data

US 2010/0215980 A1 Aug. 26, 2010

Related U.S. Application Data

(60) Provisional application No. 60/886,960, filed on Jan. 29, 2007.

(51) Int. Cl.
*C23C 2/28* (2006.01)

(52) U.S. Cl. ..... 148/533; 428/659; 427/191; 427/192

(58) Field of Classification Search ..... 148/516, 148/527, 529, 533, 579, 558; 427/383.7; 428/659

See application file for complete search history.

(56) References Cited

U.S. PATENT DOCUMENTS

| | | | | |
|---|---|---|---|---|
| 3,320,040 | A * | 5/1967 | Roe et al. | 428/659 |
| 7,241,350 | B2 | 7/2007 | Rosenthul | |
| 2005/0109433 | A1 | 5/2005 | Danger | |

FOREIGN PATENT DOCUMENTS

DE 102004035049 7/2006

OTHER PUBLICATIONS

Wienstroer, S; "Zinc/Iron Phase Transformation Studies on Galvannealed Steel Coatings by X-Ray Diffraction"; International Centre for Diffraction Data, Advances in X-Ray Analysis; vol. 46; 2003.*

EVS-EN 13811:2003, EESTI Standard Sherardizing—Zinc Diffusion Coatings on Ferrous products-Specification, Apr. 2003, pp. 1-12.

Yasuhide Morimoto et al. Excellent Corrosion-resistant Zn-Al-Mg-Si Alloy Hot-dip Galvanized Steel Sheet "Super Dyma", Nippon Steel Technical Report No. 87 Jan. 2003, pp. 24-26.

* cited by examiner

*Primary Examiner* — Jennifer McNeil
*Assistant Examiner* — Daniel J Schleis
(74) *Attorney, Agent, or Firm* — Mark M. Friedman

(57) ABSTRACT

A thin zinc diffusion coating, the diffusion coating including: (a) an iron-based substrate, and (b) a zinc-iron intermetallic layer coating the iron-based substrate, the intermetallic layer having a first average thickness of less than 15 μm, as measured by a magnetic thickness gage, the intermetallic layer having a second average thickness as measured by an X-Ray fluorescence thickness measurement, and wherein a difference between the first average thickness and the second average is less than 4 μm.

8 Claims, 10 Drawing Sheets

Figure 1 – Prior Art

Figure 2 - Prior Art

METHODS OF PREPARING THIN POLYMETAL DIFFUSION COATINGS

RELATED APPLICATIONS

This patent application is a U.S. National Phase Application of PCT/IL2008/000125 filed on Jan. 29, 2008, which claims priority of Provisional Patent Application No. 60/886,960 filed Jan. 29, 2007, the contents of which are incorporated herein by reference.

FIELD AND BACKGROUND OF THE INVENTION

The present invention relates to metallic corrosion protective coatings of iron and iron-based materials, in general, and in particular to zinc-based diffusion coatings of such materials, and to methods of producing such diffusion coatings.

It is known that metallic sacrificial corrosion-protection coatings for iron-based materials may be categorized into two main groups: thick metallic coatings for long-term outdoor applications, and thin metal coatings for limited-term outdoor applications or for indoor applications. These coatings are used to coat various surfaces, typically mechanical components such as nails, washers, bolts, screws, nuts, chain links, springs and the like.

The most popular technology for the thick coatings category is zinc hot-dip coating, also known as zinc galvanizing. In this technology, an iron or steel substrate is coated with a zinc layer, by passing the substrate through a molten bath of zinc at a temperature of around 460° C. Modern types of these coatings additionally contain aluminum, magnesium and silicon (see, by way of example, Y. Morimoto et al., "Excellent Corrosion-resistant Zn—Al—Mg—Si Alloy Hot-dip Galvanized Steel Sheet "SUPER DYMA", Nippon Steel Technical Report No. 87, January 2003). The thickness of coatings obtained by this technology usually varies between 40 μm and 100 μm.

Metallic coatings of the thin zinc-based coatings category are generally useful, as already mentioned, for indoor applications and for limited outdoor applications. These coatings are typically used as a base for organic and inorganic topcoats that provide additional required attributes like improved corrosion protection, hardness, color, etc.

The thickness of coatings of this group is usually between 4 μm and 15 μm. However, such a thickness generally provides, in and of itself, insufficient corrosion protection, and additional protection, such as a chromate passivation layer, or sealing with organic or inorganic sealers, is necessary.

The main industrial method of zinc thin coatings production is electrodeposition, also known as electroplating. This process is analogous to a reversed galvanic cell. The part to be plated is the cathode of an electric circuit, while the anode is made of zinc. Both components are immersed in an electrolyte containing one or more dissolved metal salts, such as nickel, cobalt, and manganese, as well as other ions that permit the flow of electricity. A rectifier supplies a direct current to the cathode causing the metal ions in the electrolyte solution to lose their charge and plate out on the cathode. As the electrical current flows through the circuit, the anode slowly dissolves and replenishes the ions in the bath.

Various polymetal zinc-based alloy coatings such as zinc-nickel, zinc-cobalt, zinc-iron and zinc-manganese coatings are also widely manufactured. However, it is very difficult to obtain zinc-based alloy coatings, and polymetal zinc-based alloy coatings in particular, that have a substantially uniform thickness. Usually, these coatings have some non-coated areas, as well as a highly non-uniform thickness.

As used herein in the background of the invention, the specifications and the claims section that follows the term "uniform coating" and the like, refers to a zinc diffusion coating where the deviation of individual measurements of the coating thickness are smaller than 20% of the average thickness; and the term "continuous coating" refers to a zinc diffusion coating where the coating layer coats at least 95% of the surface of the iron-based substrate.

Medium-thickness corrosion-protective coatings, of between 15 μm and 50 μm, are produced by the above-mentioned electrodeposition method, and by an additional method known as diffusion coating, vapor galvanizing, or Sherardizing. According to this method, a layer of zinc is applied to the metal substrate by heating the substrate in an airtight container containing zinc powder.

It should be stressed that Sherardizing is ideal for coating small parts, and inner surfaces of small components, as frequently required by many industries, such as the automotive industry.

In this zinc diffusion coating process, the zinc diffusion coatings are actually zinc-iron intermetallic diffusion layers of iron-based substrates. The basic concept of the process is simple: parts coated with powder mixtures containing zinc powder are loaded into a special sealed vessel, and heated up to temperatures of 340° C. to 450° C. In this temperature range, zinc atoms diffuse into the substrate and a zinc-iron intermetallic diffusion layer is formed. The thickness of the diffusion layer is a function of the process temperature, dwelling time and the quantity of the zinc powder.

It is also known that the European specification EN 13811-2003 divides zinc diffusion coatings into three classes according to their thickness range: Class 15 for coatings equal to, or greater than 15 μm, Class 30 for coatings equal to, or greater than 30 μm, and Class 45 for coatings equal to, or greater than 45 μm.

It should be noted that zinc diffusion coatings thinner than 15 μm are not characterized by these specifications because to date, such coatings have been prone to damage, do not completely cover the surface of the substrate, and are highly non-uniform. Therefore, zinc diffusion coatings thinner than 15 μm do not generally provide the required corrosion protection or the additional demanded attributes to the coated parts, and, hence, have not been widely applied in industry.

There is therefore a recognized need for, and it would be highly advantageous to have thin, continuous and uniform zinc-based diffusion coatings on iron-based materials, and methods of producing the coatings. Such thin, continuous and uniform zinc-based diffusion coatings may provide good corrosion protection to iron-based parts and serve as an excellent base for additional coatings. It would be of further advantage for the methods of producing such coatings to be simple, cost effective, and environmentally friendly, with respect to known methods.

SUMMARY OF THE INVENTION

According to the teachings of the present invention there is provided a thin zinc diffusion coating, the diffusion coating including: (a) an iron-based substrate, and (b) a zinc-iron intermetallic layer coating the iron-based substrate, the intermetallic layer having a first average thickness of less than 15 μm, as measured by a magnetic thickness gage, the intermetallic layer having a second average thickness as measured by an X-Ray fluorescence thickness measurement, and wherein a difference between the first average thickness and the second average is less than 4 μm.

According to yet another aspect of the present invention there is provided a thin zinc diffusion coating, the diffusion coating including: (a) an iron-based substrate; (b) a zinc-iron intermetallic layer coating the iron-based substrate, the intermetallic layer having a first average thickness of less than 15 μm, as measured by a magnetic thickness gage, and wherein individual thickness measurements of the intermetallic layer deviate from the average thickness by less than 20%.

According to yet another aspect of the present invention there is provided a method of preparing a thin uniform coating on an iron-based substrate, the method including the steps of (a) removing surface contaminants from the substrate to produce a cleaned substrate; (b) inhibiting at least partially new oxidation of the cleaned substrate; (c) mixing the cleaned substrate with at least one powder in a vessel in a non-oxidizing environment, the at least one powder including metallic zinc and a finely divided additive, and (d) heating a content of the vessel to effect a zinc diffusion coating of the metallic zinc on the cleaned substrate to form a zinc-coated substrate, wherein the additive increases an alkalinity in the vessel to a pH of at least 6.

According to yet another aspect of the present invention there is provided a method of preparing a thin uniform coating on an iron-based substrate, the method including the steps of (a) removing surface contaminants from the substrate to produce a cleaned substrate; (b) inhibiting at least partially new oxidation of the cleaned substrate; (c) mixing the cleaned substrate with at least one powder in a vessel in a non-oxidizing environment, the at least one powder including metallic zinc and a clay mineral, and (d) heating a content of the vessel to effect a zinc diffusion coating of the metallic zinc on the cleaned substrate to form a zinc-coated substrate.

According to further features in the described preferred embodiments, the first average thickness is less than 12 μm.

According to still further features in the described preferred embodiments, the first average thickness is less than 10 μm.

According to still further features in the described preferred embodiments, the first average thickness is less than 8 μm.

According to still further features in the described preferred embodiments, the difference between the first average thickness and the second average thickness is less than 3.5 μm.

According to still further features in the described preferred embodiments, the difference between the first average thickness and the second average thickness is less than 3 μm.

According to still further features in the described preferred embodiments, the difference between the first average thickness and the second average thickness is less than 2.5 μm.

According to still further features in the described preferred embodiments, the difference between the first average thickness and the second average thickness is less than 2.0 μm.

According to still further features in the described preferred embodiments, a ratio of the first average thickness to the second average is less than 2.5:1.

According to still further features in the described preferred embodiments, a ratio of the first average thickness to the second average thickness is less than 2.2:1.

According to still further features in the described preferred embodiments, a ratio of the first average thickness to the second average thickness is less than 2.0:1.

According to still further features in the described preferred embodiments, a ratio of the first average thickness to the second average thickness is less than 1.8:1.

According to still further features in the described preferred embodiments, the intermetallic coating layer coats at least 95% of a surface of the iron-based substrate.

According to still further features in the described preferred embodiments, the intermetallic coating layer coats at least 98% of a surface of the iron-based substrate.

According to still further features in the described preferred embodiments, individual thickness measurements of the intermetallic layer deviate from the average thickness by less than 20%.

According to still further features in the described preferred embodiments, individual thickness measurements of the intermetallic layer deviate from the average thickness by less than 15%.

According to still further features in the described preferred embodiments, individual thickness measurements of the intermetallic layer deviate from the average thickness by less than 15%.

According to still further features in the described preferred embodiments, a ratio of the first average thickness to the second average thickness is less than about 1.7:1.

According to still further features in the described preferred embodiments, the zinc-iron intermetallic layer contains at least 60% zinc.

According to still further features in the described preferred embodiments, the zinc-iron intermetallic layer further includes an additional metal, other than zinc and iron, alloyed with the zinc.

According to still further features in the described preferred embodiments, a composition of the zinc-iron intermetallic layer contains at least 0.2%, by weight, of the additional metal.

According to still further features in the described preferred embodiments, a composition of the zinc-iron intermetallic layer contains at least 0.4%, by weight, of the additional metal.

According to still further features in the described preferred embodiments, a composition of the zinc-iron intermetallic layer contains at least 0.5%, by weight, of the additional metal.

According to still further features in the described preferred embodiments, the additional metal includes metallic aluminum, alloyed with the zinc.

According to still further features in the described preferred embodiments, the additional metal includes metallic magnesium, alloyed with the zinc.

According to still further features in the described preferred embodiments, the additional metal includes metallic silicon, alloyed with the zinc.

According to still further features in the described preferred embodiments, the additional metal includes tin, alloyed with the zinc.

According to still further features in the described preferred embodiments, the additional metal includes nickel, alloyed with the zinc.

According to still further features in the described preferred embodiments, the heating of the content of the vessel is effected up to a temperature of between 300° C. and 380° C.

According to still further features in the described preferred embodiments, the heating of the content of the vessel is effected up to a temperature of between 340° C. and 380° C.

According to still further features in the described preferred embodiments, the zinc diffusion coating on the cleaned substrate is thinner than 15 μm, as measured by a magnetic thickness gage.

According to still further features in the described preferred embodiments, the vessel is a rotating vessel.

According to still further features in the described preferred embodiments, the additive binds with water on a surface of the cleaned substrate to enhance a formation of the zinc diffusion coating.

According to still further features in the described preferred embodiments, the additive binds with water solely on a surface of the cleaned substrate to enhance the formation of the zinc diffusion coating.

According to still further features in the described preferred embodiments, the additive is substantially inert with respect to zinc and iron.

According to still further features in the described preferred embodiments, the additive physically prevents direct contact between water and as yet uncoated parts of the coated substrate.

According to still further features in the described preferred embodiments, the additive includes a non-metallic material.

According to still further features in the described preferred embodiments, the additive includes a clay mineral.

According to still further features in the described preferred embodiments, the clay mineral includes kaolin.

According to still further features in the described preferred embodiments, a quantity of the clay mineral is larger than 0.1% of a quantity of the metallic zinc in the powder.

According to still further features in the described preferred embodiments, a quantity of the kaolin is larger than 0.1% of a quantity of the metallic zinc in the powder.

According to still further features in the described preferred embodiments, the quantity of the kaolin is between 0.1% and 3% of a quantity of the metallic zinc in the powder.

According to still further features in the described preferred embodiments, the non-oxidizing environment is a substantially nitrogen atmosphere.

According to still further features in the described preferred embodiments, the inhibiting new oxidation of the cleaned substrate is performed by contacting the clean substrate with a melted flux containing sodium chloride and aluminum chloride salts.

According to still further features in the described preferred embodiments, the at least one powder further includes at least one additional powder selected from the group consisting of metallic aluminum, metallic magnesium, metallic nickel, metallic tin and silicon.

According to still further features in the described preferred embodiments, the at least one powder further includes metallic iron.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice. Throughout the drawings, like-referenced characters are used to designate like elements.

In the drawings.

DESCRIPTION OF THE PREFERRED EMBODIMENTS

Aspects of the present invention include thin, uniform, and continuous zinc-based coatings of iron and iron-based materials, and methods of producing such coatings.

The principles and operation of the compositions and method according to the present invention may be better understood with reference to the figures and the accompanying description.

Before explaining at least one embodiment of the invention in detail, it is to be understood that the invention is not limited in its application to the specific formulations set forth in the following description and figures. The invention is capable of other embodiments without departing from the spirit of essential attributes thereof. Also, it is to be understood that the phraseology and terminology employed herein is for the purpose of description and should not be regarded as limiting.

It is well known to those skilled in the art that the thickness of diffusion coatings depend on the following four parameters: temperature, dwelling time, powder quantity per surface unit, and the rotating rate of the vessel.

As used herein in the specifications and in the claims section that follows, the term "iron-based" with respect to materials, substrates, and parts, refers to such materials, substrates, and parts made of a substance including at least 50% w/w iron, typically at least 90% w/w iron, and more typically at least 95% w/w iron.

Although it seems trivial to reach the required diffusion coating thickness by optimizing these parameters, it is known that such optimization works only for relatively thick diffusion coatings.

If one has optimized, for instance, the coating process for 40 μm thickness and tries to reduce the powder quantity to 25% of the optimized quantity, without changing the other parameters, he expects to obtain a coating thickness of 10 μm. Actually, this does not happen, and it is generally impossible to obtain, by prior art methods, continuous thin diffusion coatings having uniform thickness.

Figure 1:
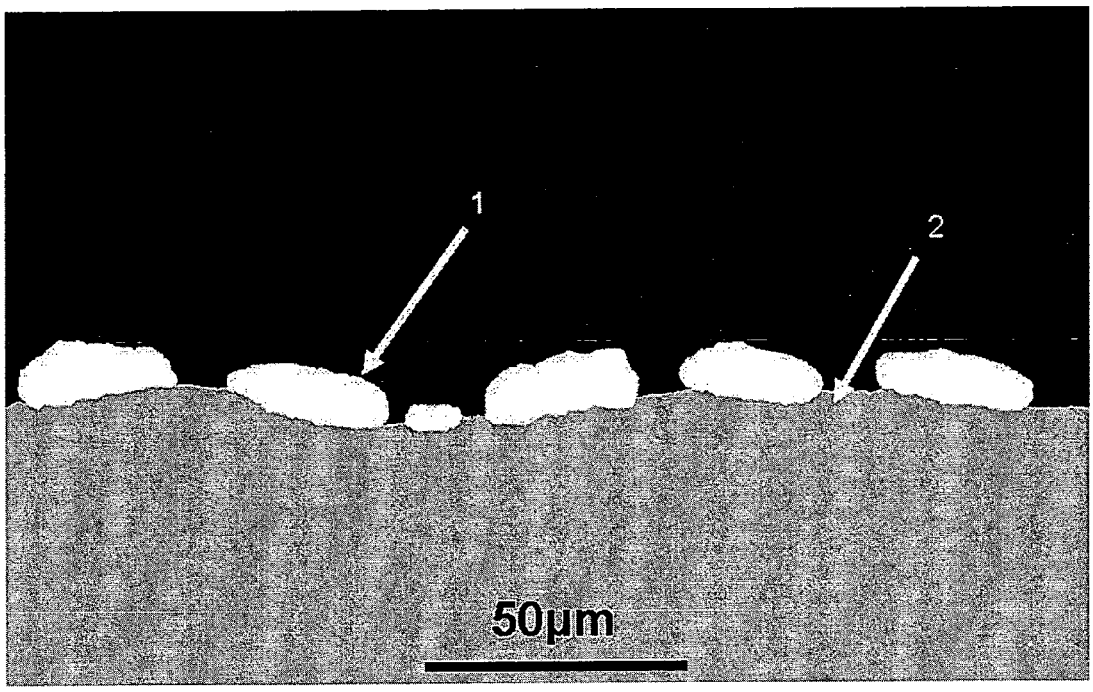
FIG. 1 is a prior art microstructure of a thin, non-uniform zinc diffusion coating of an iron-based substrate.

Referring now to the figures, FIG. 1 shows a prior art microstructure of a highly non-uniform zinc diffusion coating of an iron-based substrate. It is manifest that the coating is made up of plurality of non-continuous, island-like zinc diffusion coated areas such as zinc diffusion coated area 1, which only partially cover the surface of the iron-based substrate. Zinc diffusion coated area 1 is surrounded by many bare non-coated areas such as non-coated area 2. Thus, the substrate surface as a whole consists largely of island-like zinc diffusion coated areas of the zinc-iron intermetallic phase, surrounded by non-coated areas that are covered by oxides and other coating inhibitors.

This state of the art is reflected in a new Russian standard ГОСТ Р 9316-2006, "Zinc Thermo Diffusion Coatings", which went into effect beginning in June 2007. This standard contains six different thickness classes (according to paragraph 6.8.1 of the standard).

The thickness of zinc diffusion coatings may be measured by one or more of the following methods:

(a) Pickling: the sample is weighed before and after pickling in a suitable agent, usually acids such as hydrochloric acid. The zinc coating completely reacts with the pickling agent, while the reaction between the iron substrate and the agent is insubstantial.

The coating thickness T is calculated by the formula:

$$T=\Delta W/(S*G)$$

where ΔW is the weight difference of the sample before and after pickling, S is the surface area of the sample, and G is the specific gravity of zinc.

(b) X-Ray Fluorescence (XRF): a method that measures the zinc quantity on the measured sample. The thickness of the zinc coating is calculated similarly to the former method, but since zinc-based diffusion coatings contain about 12% of the iron quantity, the measured thickness of coatings determined by this method are approximately 10% lower than the thickness determined by the pickling method.

(c) Metallographic, also known as crystallographic examination: the actual coating thickness, and the microstructure, are microscopically examined on a cross-section of the sample.

(d) Magnetic method: this method measures the distance between a probe of the measuring instrument, and the ferromagnetic iron-based substrate. Attention must be drawn to the fact that part of the space between the probe and the substrate may be filled by other non-ferromagnetic materials, or by hollow volumes or bubbles in the coating, often yielding erroneous results.

Referring back to the Russian standard, Class 1 of the standard, for example, requires a coating thickness of 6 μm to 9 μm. According to Table C1 in appendix C of the standard, the coating thickness may be measured by the magnetic method or by the XRF method. While the first method should determine a thickness of 6 μm to 9 μm, the second method should determine, according to this standard, a thickness of only 1.5 μm to 3 μm. As already explained hereinabove, the enormous difference in the determined thickness, results from a non-perfect coating having some uncoated areas 2. The magnetic method actually measures the thickness of the island-like zinc diffusion coated areas of the coated substrate, while the XRF method measures the actual average coating thickness on the tested area.

The fact that this modern standard allows a discrepancy between different thickness measuring methods is firm evidence that zinc diffusion coatings thinner than 15 μm, manufactured by prior art methods are non-continuous and non-uniform.

It must be emphasized that even the use of very fine zinc powder, having a grain size of about 5 μm, does not solve the problem, and the obtained coating is still non-uniform, and is characterized by island-like zinc diffusion coated areas. Without wishing to be limited by theory, we believe that this phenomenon occurs as a result of coalescence of zinc atoms on the substrate surface at the diffusion temperature of 340° C. to 450° C. during the coating process. This coalescence occurs because mutual diffusion and agglomerated powder grains in the vicinity of the melting point causes an increase of the actual powder grain size.

Even the use of special inert materials, usually sand, to prevent grain growth in the zinc powder does not provide continuous and uniform coverage of the substrates in prior art diffusion coatings thinner than 15 μm. Consequently, zinc diffusion coatings thinner than 15 μm do not provide the required corrosion protection and, therefore, are rarely practiced in the art.

Again, without wishing to be limited by theory, we believe that the incomplete coverage of thin zinc diffusion coatings using prior art techniques may have an additional explanation. Two main solid phases participate in the diffusion coating process: an iron-base substrate and zinc powder. At temperatures below the melting point of zinc, two processes occur: the above-mentioned coalescence of zinc powder particles and a chemical reaction between zinc and iron to form a zinc-iron intermetallic phase on the substrate surface.

However, the formation of the intermetallic phase happens at temperatures below 380° C. substantially solely on areas totally clean from iron oxides and hydroxides. It is not feasible, or at least impractical, to perfectly clean real parts under industrial conditions in which the atmosphere in the furnaces, and the atmosphere in the rotating vessels for zinc diffusion coating, contain air and water, some of which become absorbed on the coated parts and powder grains, and inhibit formation of the zinc-iron intermetallic phase. Therefore, only non-continuous, island-like zinc diffusion coated areas are formed.

At temperatures above 380° C., in presence of a large quantity of zinc powder, zinc reacts with iron oxides. The deoxidization of the iron actually cleans the surface. Subsequently, the zinc-iron reaction begins on the entire cleaned surface, and a thick coating is formed on the entire area.

In order to prevent substrate oxidation, the diffusion coating is performed in a non-oxidizing environment, such as a nitrogen atmosphere. Another possibility is to add organic additives for iron deoxidizing. In any event, these additional procedures notwithstanding, a thin film of iron oxide is formed, such that a plurality of island-like zinc diffusion coated areas 1, surrounded by many non-coated substrate parts 2, is observed.

In addition, during the rotation of the vessel, coated parts bumping into each other damage both the oxide film and the new diffusion coating areas, and contribute to the formation of these island-like zinc diffusion coated areas.

Figure 2:
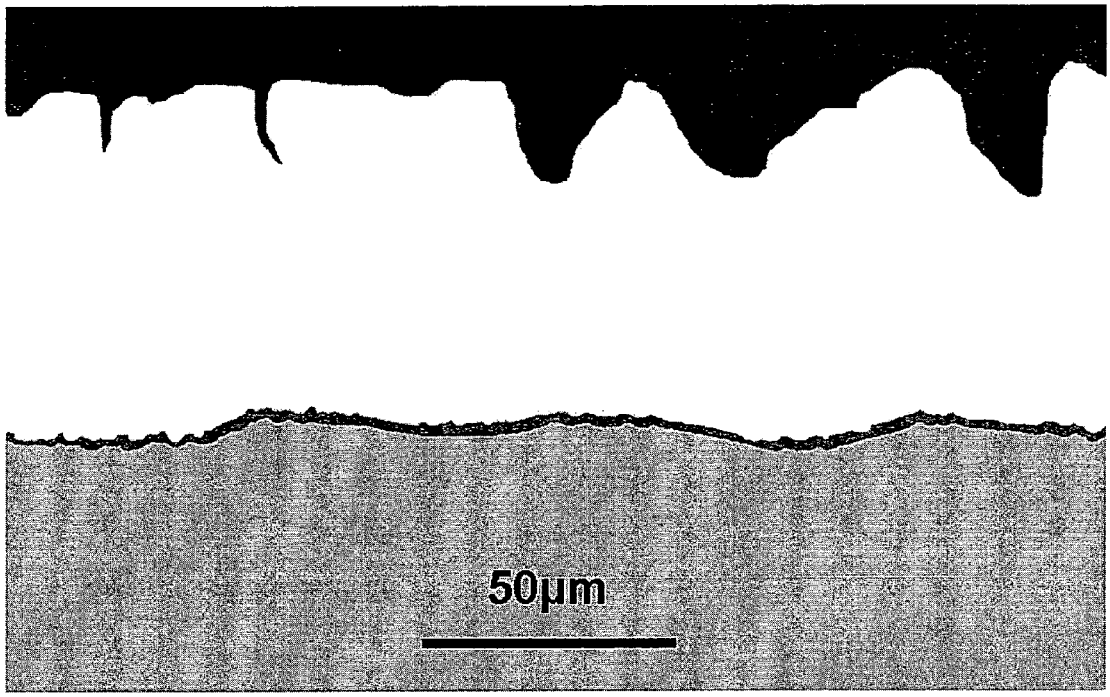
FIG. 2 shows a prior art microstructure of a thin zinc diffusion coating of an iron-based substrate having a highly varying coating thickness.

Referring now to FIG. 2, FIG. 2 shows a prior art microstructure of a thick diffusion coating of an iron-based substrate. In this case, an effort was made to get a uniform zinc coating of the iron substrates by increasing the powder quantity, heating the vessel to above 380° C., and utilizing a short dwelling time. However, island-like zinc diffusion coated areas were obtained at the first heating stage of the process. These areas quickly grew, until, finally a thick coating was obtained. However, this thick coating is characterized by large deviations of individual thickness measurements with respect to the relatively large average thickness.

When a large quantity of powder is used and the dwelling time is reduced, while the temperature is kept high, the obtained coating, again, does not have a uniform thickness, because the time is too short for filling partially coated areas. Thus, the thickness fluctuates again around a relatively large average thickness.

Thus, it appears impossible to obtain a thin continuous and uniform zinc diffusion coating on an iron-based substrate using prior art methods.

It is known that an oxide film is formed on iron-based substrates even in a deoxidizing atmosphere. Hence, one can conclude that the iron-based substrate reacts with water, and not with oxygen, on the surface of the iron substrate.

Figure 3:
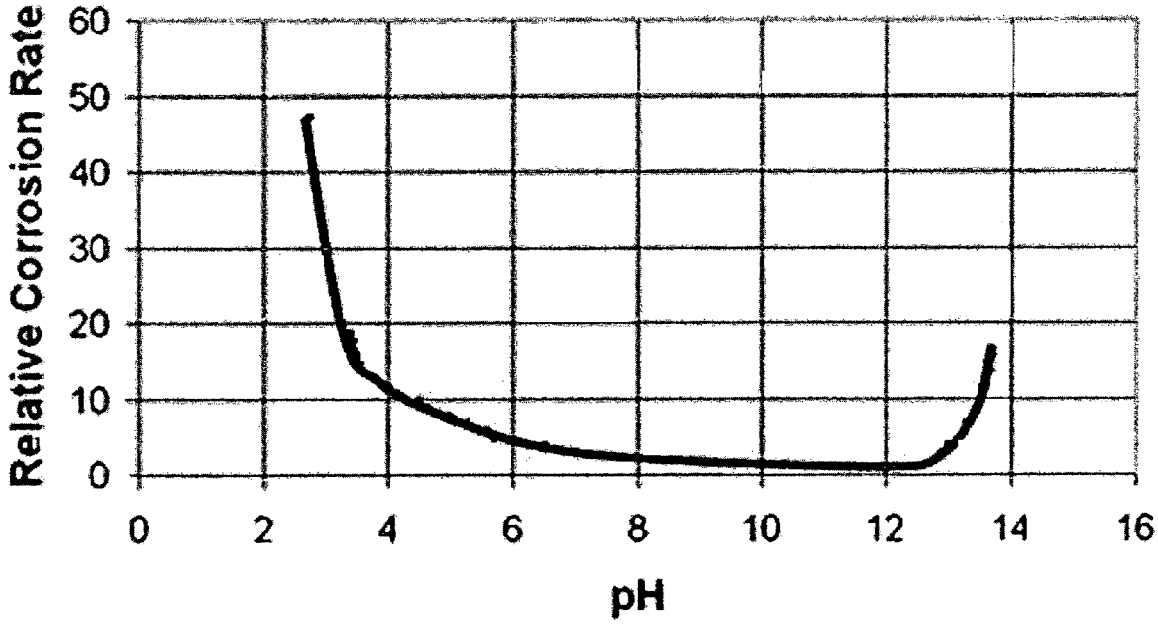
FIG. 3 is a plot showing the corrosion rate of zinc as a function of pH.
Figure 4:
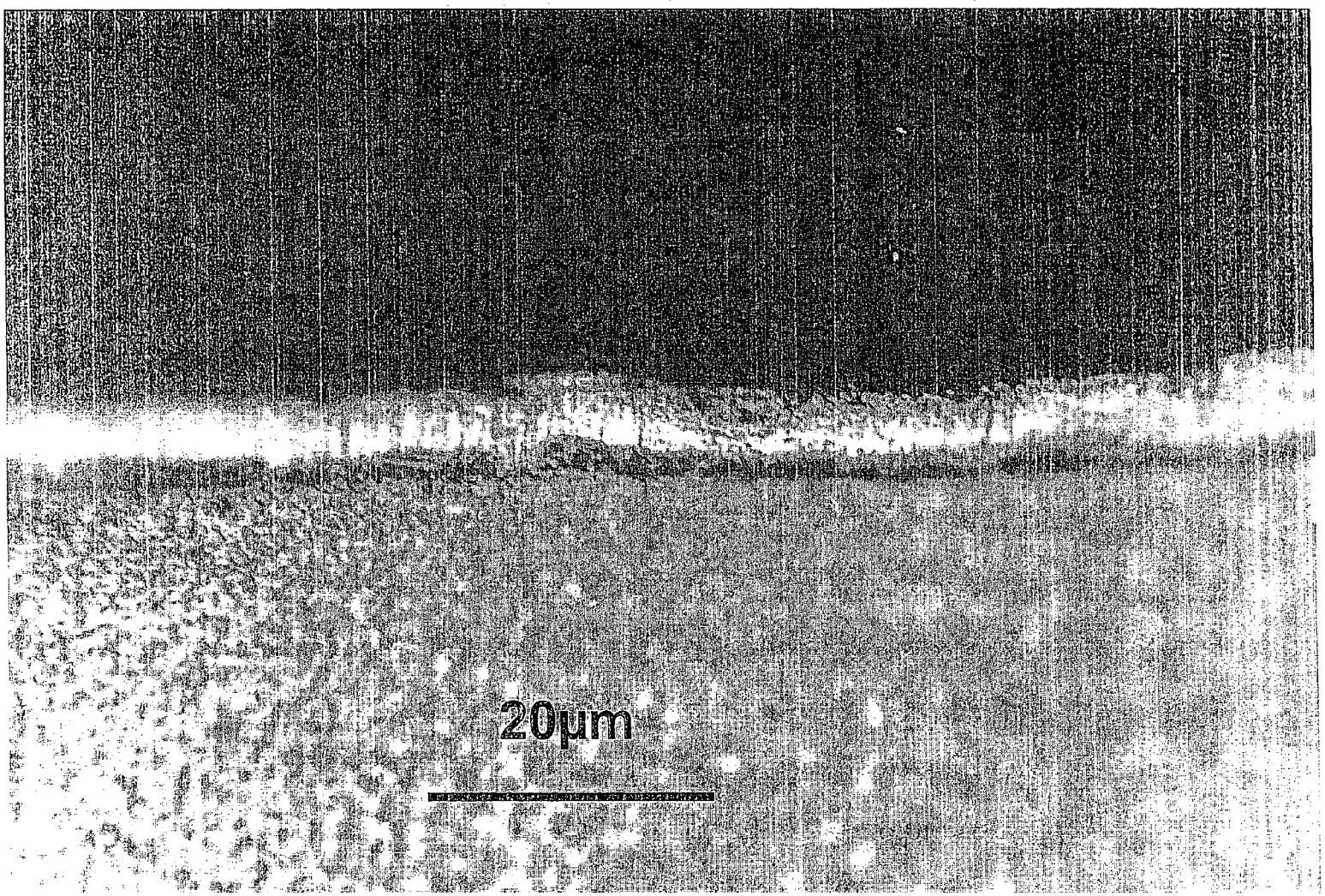
FIG. 4 is a photograph showing the diffusion coating microstructure of Experiment No. 1 of the present invention, wherein the powder added to the iron substrate contains zinc powder and kaolin.
Figure 5:
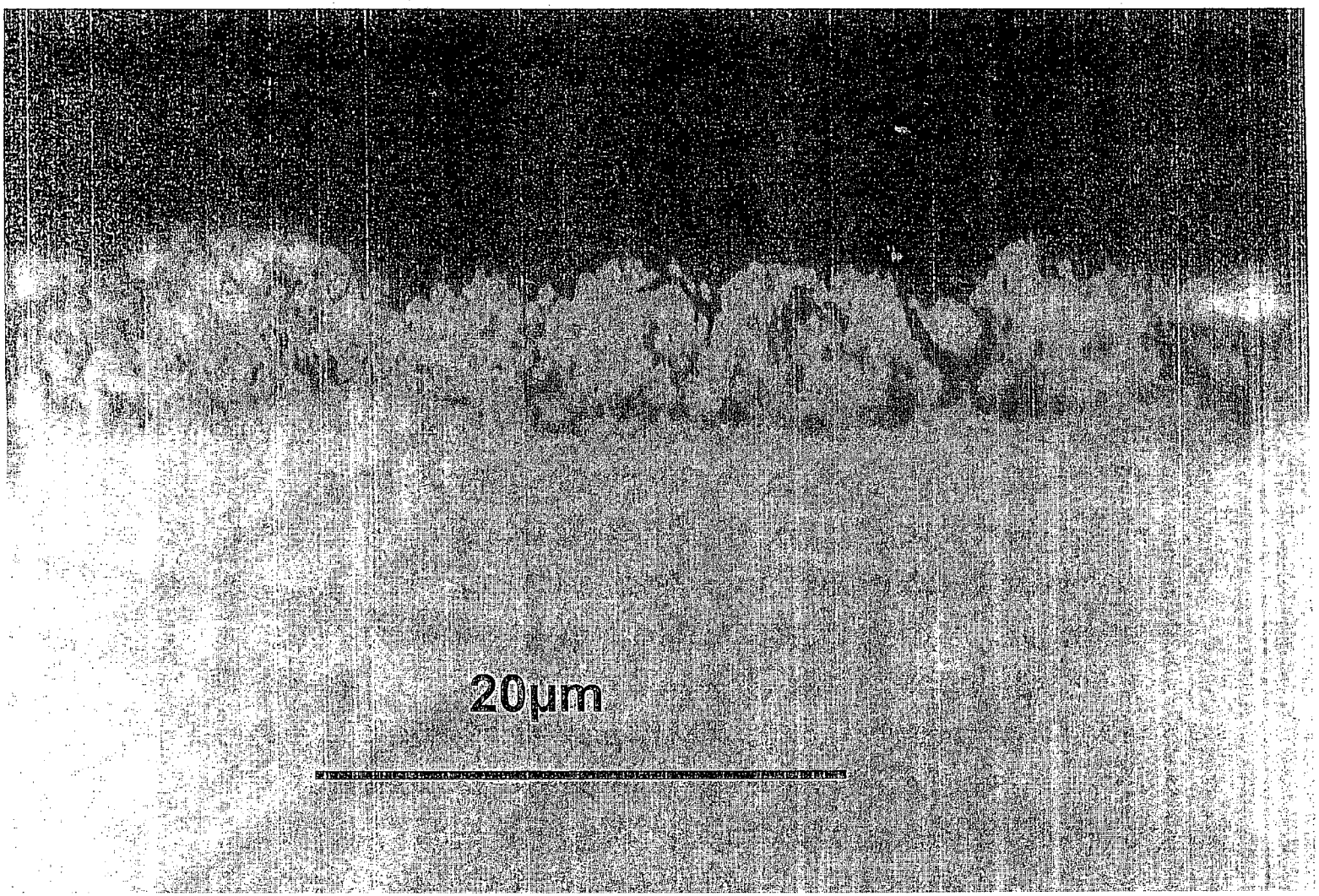
FIG. 5 shows the diffusion coating microstructure of Experiment No. 2, wherein the zinc powder additionally contains 1% (weight/weight zinc) of Si powder.
Figure 6:
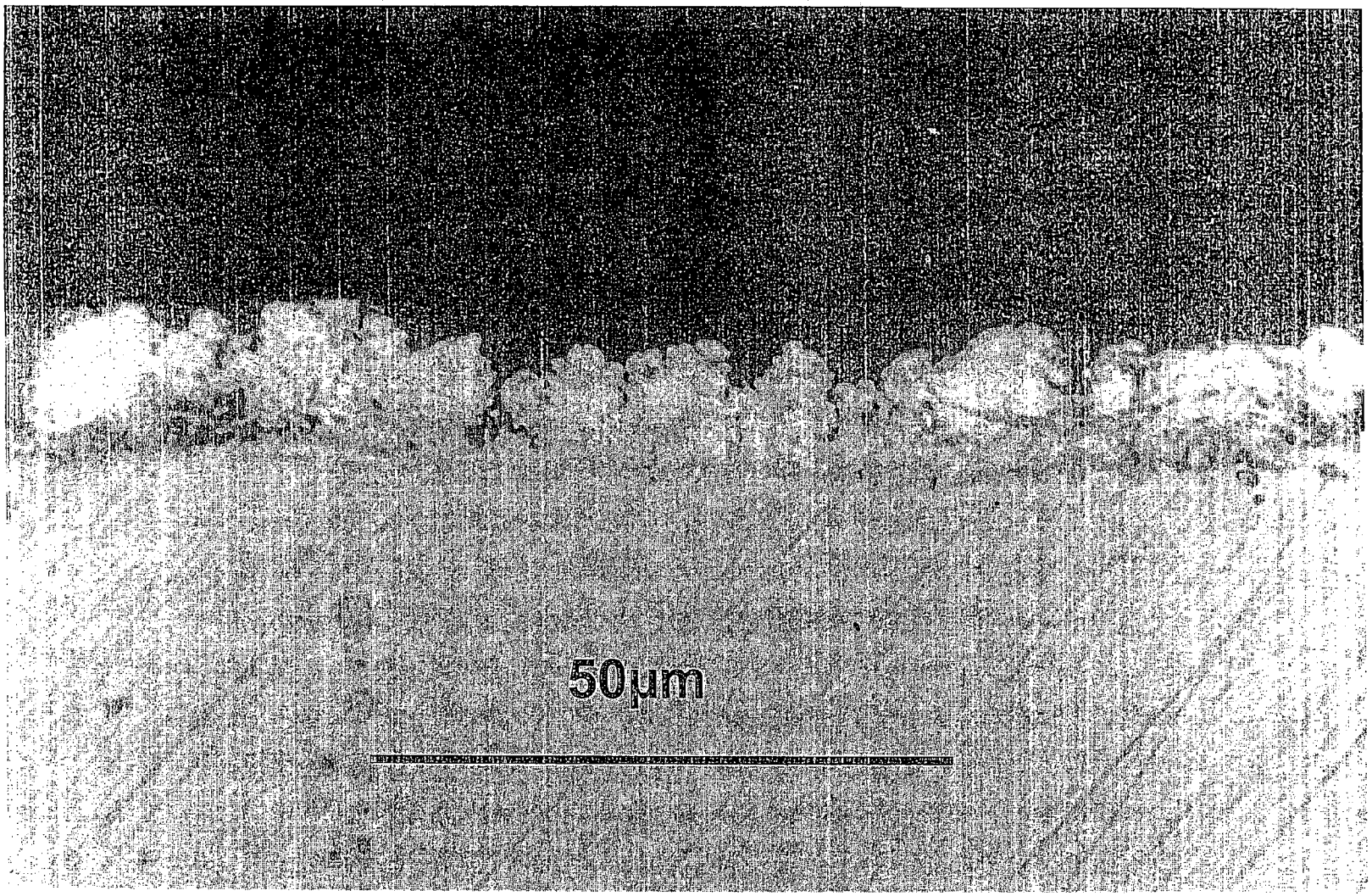
FIG. 6 shows the diffusion coating microstructure of Experiment No. 3, wherein the zinc powder additionally contains 2% (weight/weight zinc) of nickel powder.
Figure 7:
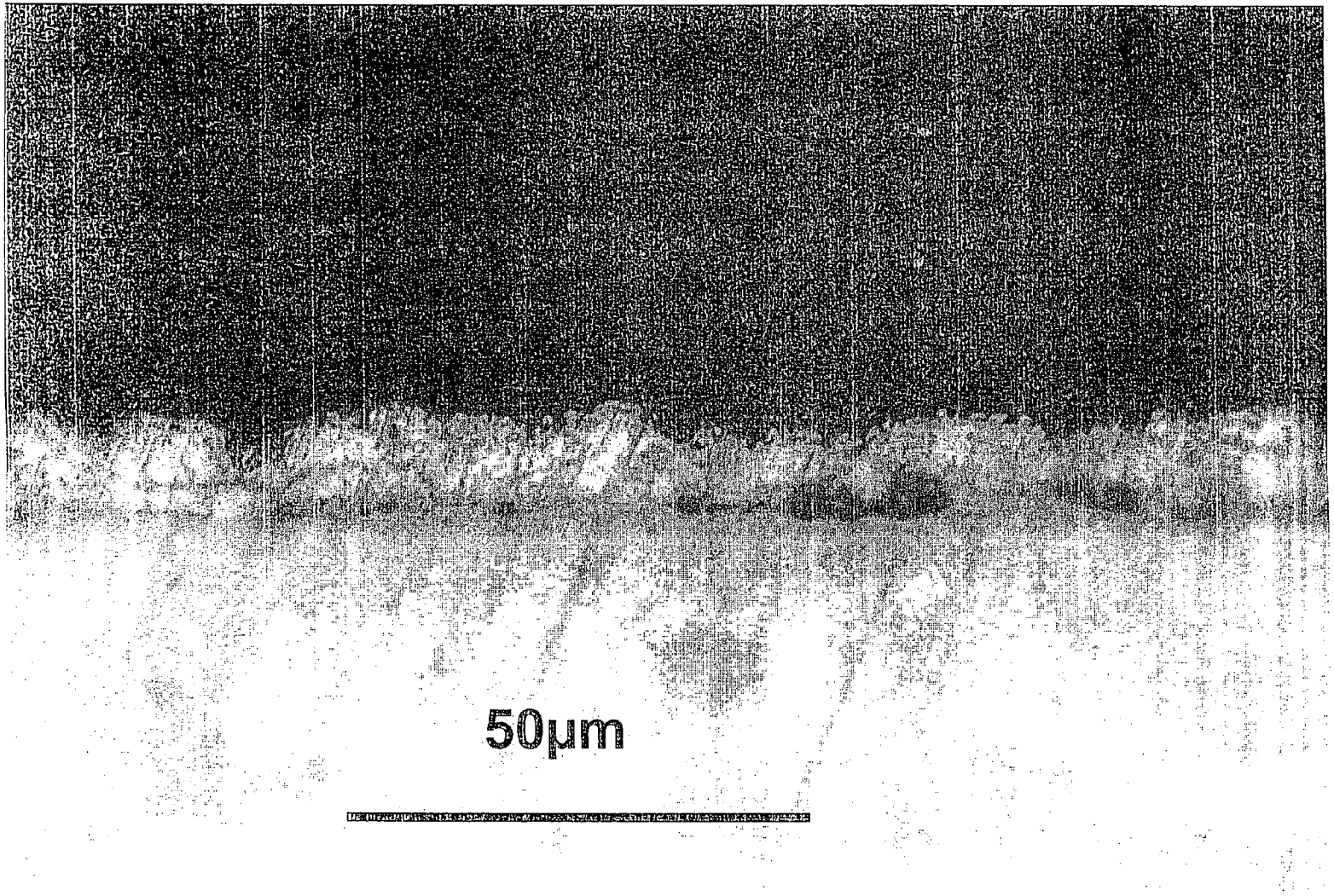
FIG. 7 is a photograph showing the diffusion coating microstructure of Experiment No. 4 of the present invention, wherein the zinc powder additionally contains 2% (weight/weight zinc) of tin powder.
Figure 8:
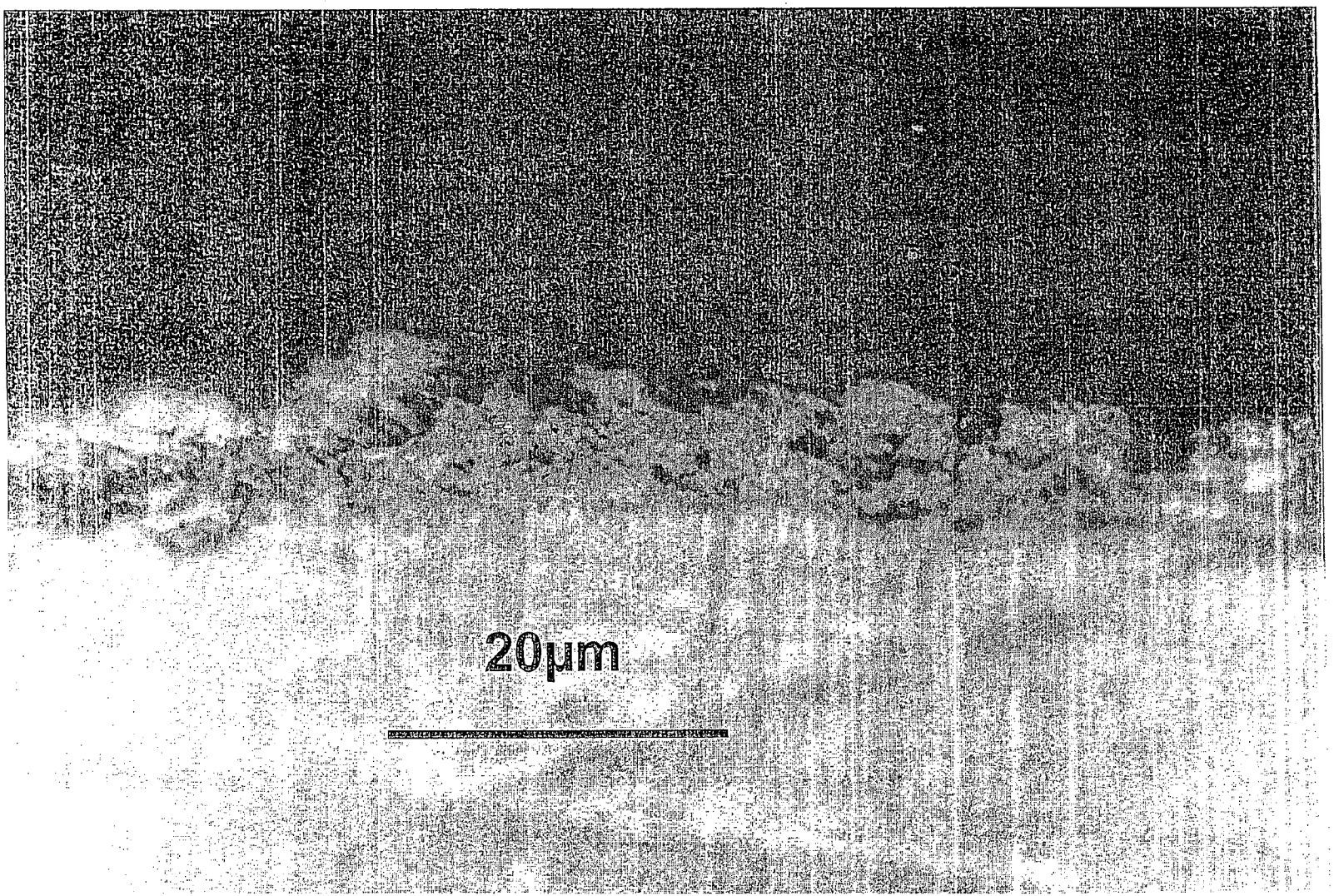
FIG. 8 is a photograph showing the diffusion coating microstructure of Experiment No. 5 of the present invention wherein the zinc powder additionally contains 1% (weight/weight zinc) of iron powder.
Figure 9:
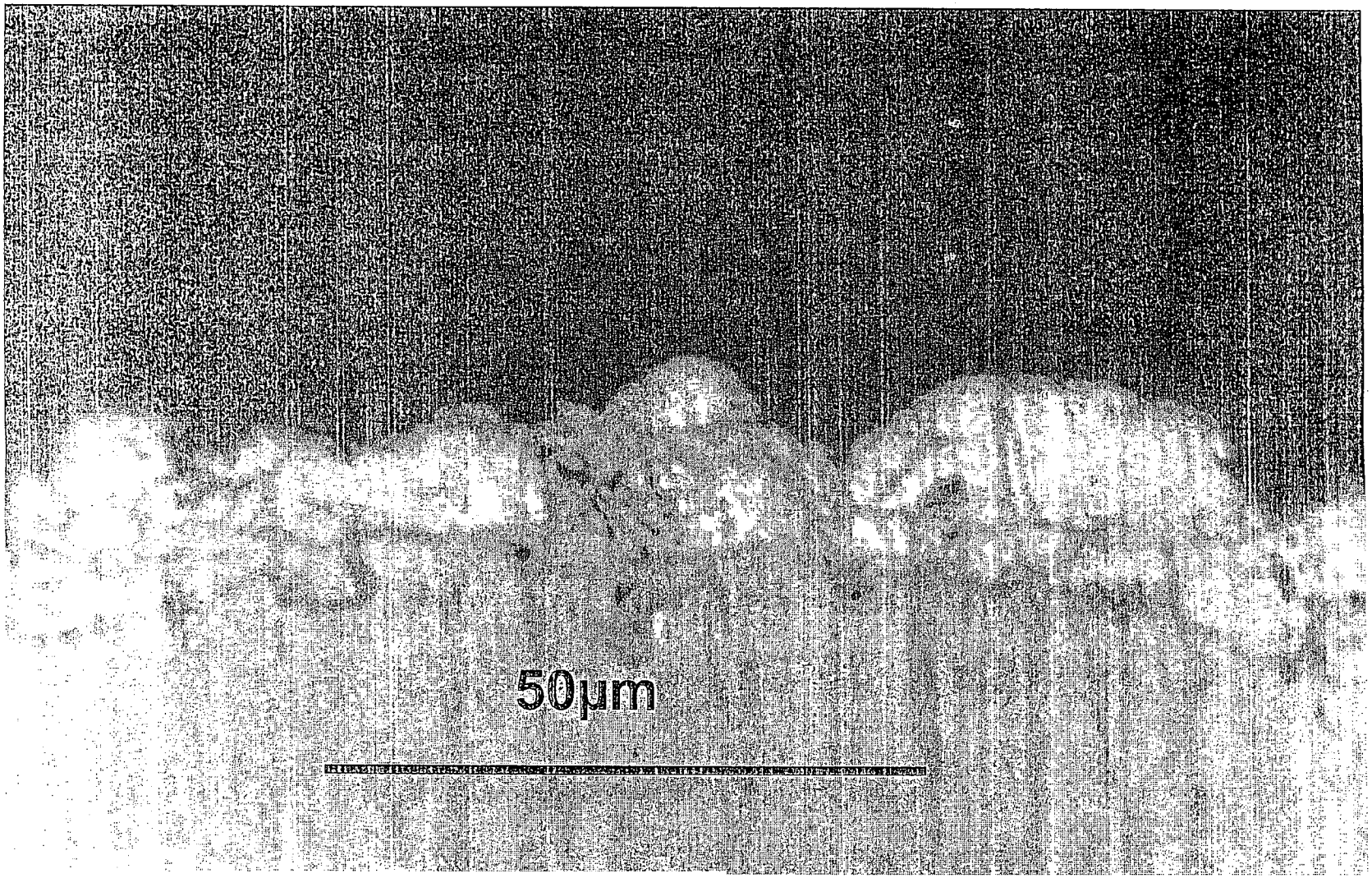
FIG. 9 shows the diffusion coating microstructure of Experiment No. 6 wherein the zinc powder additionally contains 0.5% of aluminum and 0.5% of magnesium powders (weight/weight zinc)
Figure 10:
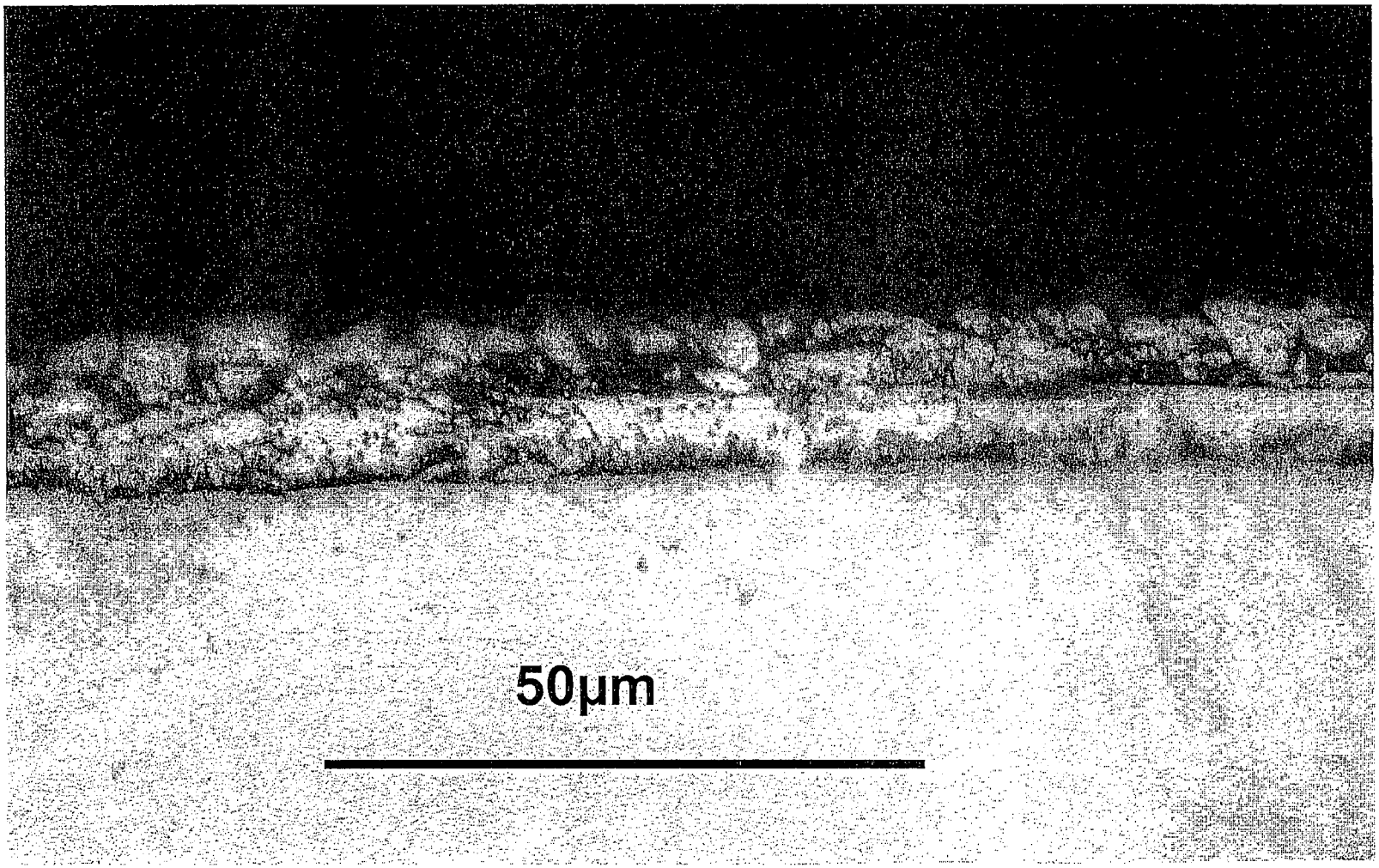
FIG. 10 shows the diffusion coating microstructure of Experiment No. 7 wherein the zinc powder additionally contains 0.5% of aluminum, 0.5% of magnesium, and 0.5% of silicon powders (weight/weight zinc).

It is also known that iron begins to react with water at a temperature of about 100° C., while zinc begins to intensely react with water at a temperature higher than 650° C. By sharp contrast, and as can be seen from the plot of the corrosion rate of zinc as a function of pH, provided in FIG. 3, in a basic environment, zinc reacts very intensely with water, even at room temperature.

These phenomena were applied in the present invention to inhibit the formation of oxide films. Zinc powder is utilized as a sacrificial material, and suitable conditions are provided for the water to react with the zinc powder rather than with the iron substrate surface. The surface area of the zinc powder is much larger than the surface area of the coated parts, and films of zinc oxide and zinc hydroxide, formed on the surface of powder particles, are only local and are very thin.

Based on all of the above, it appears possible to prevent the formation of a film of iron oxides by increasing the alkalinity of the water on the surface of the substrate. This condition may be satisfied by utilizing various compounds of basic metals, however, the final coatings in these cases will contain these metals, and their required corrosion protection will be reduced significantly.

Thus, in the present invention, while additives may be added to prevent the formation of a film of iron oxides, such additives should ideally satisfy the following requirements:

1. An additive should increase the alkalinity of water in the vessel without substantially influencing the coating properties. Therefore, the additive should be chemically inert, practically, with respect to zinc and iron.
2. To effectively reduce the required additive quantity, it is highly advantageous to use materials that react with water solely, or largely, on the surface of the coated parts.
3. The additive should prevent the formation of a film of iron oxides from about 100° C. where the zinc oxidation process starts, and 300° C. to 350° C., when the zinc diffusion coating starts to form.
4. The additive should prevent or largely inhibit direct contact between water and the surface of the substrate, and should enable zinc diffusion into the iron-base substrate.

Generally, clay minerals, which are poly alumino-silicates, may be used as suitable additives for performing thin zinc diffusion coating.

According to a preferred embodiment of the present invention, the clay mineral additive includes kaolin, $Al_4[(OH)_8Si_4O_{10}]$, also known as china clay, which effectively fulfills all these requirements. Kaolin intensely absorbs water, and contains a significant quantity of hydroxyl groups at temperatures up to about 500° C., which increase the alkalinity of the absorbed water. In addition, kaolin has a lamellar structure that is very easily stratified into very thin lamellas having a characteristic thickness of less than 1 μm. These lamellas readily adhere to metal surfaces, and a very small quantity of this additive is enough to completely cover the surface of coated parts and to localize the reaction on the surface area. In commercial kaolin, typically 95% to 100% of the grains are smaller than 10 μm.

It should be emphasized that all the embodiments of the present invention of zinc polymetal diffusion coatings on iron-based materials, which use additives that fulfill the requirements mentioned hereinabove, provide thin, uniform and continuous diffusion polymetal coatings that have the following main advantages:

The method is simple and environmentally friendly, the thickness-range of the coating is wide, and varies from about 4 μm to 15 μm. The coating thickness, measured on a metallographic specimen is highly uniform having an utmost deviation from the average of only 20%. The coatings thickness measurements determined by the various methods are substantially equal and suitable for application on complicated parts. They have excellent adhesion of topcoats, and their properties, such as hardness, porosity, corrosion resistance etc. may be modified by varying their chemical composition. These zinc polymetal diffusion coatings may serve as an extraordinary base for further treatments and additional coatings often demanded by various industries.

EXAMPLES

It will be appreciated that the descriptions hereinbelow are intended only to serve as examples and that many other embodiments are possible within the spirit and the scope of the present invention.

Below is provided a list of reagents used for the preparation of various formulations of powder mixtures for zinc diffusion coatings of iron-based substrates according to the present invention. Seven different powder mixtures were tested, each having a unique composition of metallic powder components (modifying components or "MC") in addition to the zinc powder.

1. Zinc powder supplied by Nyngbo Hehgneng New Material Ltd. (China). The powder included 99.5% of metallic zinc, having a grain size of 98%≦50 μm.
2. Aluminum powder supplied by Eska Granules (Switzerland). The powder included 99.5% of metallic aluminum, having a grain size of 98%≦45 μm.
3. Magnesium powder supplied by Zika Electrode Works Ltd. (Israel). The powder included 99.8% of metallic magnesium, having a grain size of 100%≦75 μm.
4. Silicon powder supplied by Riedel—de Haen (Germany). The powder included 99% of metallic silicon, having a grain size of 100%≦44 μm.
5. Nickel powder supplied by Zika Electrode Works Ltd. (Israel). The powder included 99.5% of metallic nickel, having a grain size of 98%≦40 μm.
6. Tin powder supplied by Amdikat Ltd. (Israel). The powder included 99.88% of metallic tin, having a grain size of 94.2%≦44 μm.

7. Iron powder supplied by Hórganás Company (Sweden). The powder included 99% of metallic iron, having a grain size range of 25.7%<45 μm, 73.5%≧45 μm and ≦180 μm.
8. Kaolin, type Puraflo HB-1, produced by WBB Minerals Ltd. The powder contained 49% $SiO_2$ and 35.1% $Al_2O_3$.

In all these examples of the present invention for a diffusion coating method the following parameters were maintained:

Temperature: 350° C. The temperature was measured by a thermocouple installed in the vessel;

Dwelling time: 60 minutes;

Rotation speed: 0.8 rpm; and

Inert non-oxidizing environment: Nitrogen at a flow rate of 0.5l/min.

The examples were untreated identical plates of 20×34×2 mm made of SAE 1010 steel. These plates were mechanically cleaned from surface contaminants such as scale and rust, and protected against new rusting by melted flux consisting of sodium chloride and aluminum chloride salts, as recommended in U.S. Pat. No. 4,261,746 to Langston, et al. This patent discloses that sodium chloride is mixed with aluminum chloride to form a double salt of $NaAlCl_4$.

The samples were rotated with 17 grams of zinc powder in a heated cylindrical vessel with inner ribs that improve the mixing of the powder mixture. The dimensions of the vessel were: 165 mm diameter and 120 mm length. Each experiment included a batch of 15 samples. At the end of the process, the coated parts were cooled to ambient temperature in the vessel, and washed in tap water.

After the coating, some of the samples were phosphatized and some were coated with 20 μm to 25 μm of epoxy cataphoretic e-coating (CDP), which is a process for painting metal bodies by applying DC current to metal parts immersed in electricity conducting paint or lacquer.

In carrying out these experiments, the following equipment was used:

Analytical balance: A&D, model HF-300G;

Magnetic thickness gage: Electormatic Equipment Co, model DCF-900;

C, Nikon, model Optihot-100S; and

Micro-hardness tester: Buehler, model Micromet 2100.

X-ray fluorescence measuring device Fischerscope®, Helmut Fischer Company.

The magnetic thickness gage utilizes measurement techniques of electromagnetic induction and eddy current to measure a wide variety of coatings on metal substrates. Attention must be drawn to the European specification EN 13811-2003 stating that since the area over which each measurement is made in this method is very small, individual figures may be lower (typically up to 15%) than the value for the local thickness, and that the thickness of the sample is decided by the calculated average value. The continuity of the coatings was determined by the metallographic method.

The thickness of samples 1 and 6 was determined by all the four methods of thickness measurements: pickling, XRF, metallography, and the magnetic methods, and compared to the above-mentioned Russian specifications.

The micro-hardness tester determines the Knoop hardness, which is a micro-hardness test for mechanical hardness used particularly for very thin sheets, where only a small indentation may be made for testing purposes. A pyramidal diamond point is pressed into the polished surface of the test material with a known force, for a specified dwelling time, and the resulting indentation is measured using a microscope. The Knoop hardness UK is then determined by the depth to which the indenter penetrates.

The obtained quality of the zinc diffusion coatings of these samples was determined by neutral salt spray tests (SST) performed according to ASTM B 117-03. The criterion for failure was determined as corroded substrate area exceeding 5% of the total sample area.

As already mentioned hereinabove, all experiments were carried out with kaolin as an additive. Very small amounts of kaolin fulfill the requirements for a suitable additive for zinc diffusion coating of iron-based parts, as delineated hereinabove.

The experimental results are summarized in Table 1.

TABLE 1

| Test # | MC type | MC, weight % | Coating thickness, μm | SST results, hrs: Phosphating finishing | SST results, hrs: CDP finishing | Micro-hardness, HK 10 g, average | Fig. # |
|---|---|---|---|---|---|---|---|
| 1 | — | — | 5 | 96 | 980 | 400 | 4 |
| 2 | Si | 1 | 5 | 96 | 720 | 1) | 5 |
| 3 | Ni | 2 | 9 | 120 | 720 | 160 | 6 |
| 4 | Sn | 2 | 8 | 48 | 480 | 130 | 7 |
| 5 | Fe | 1 | 7 | 96 | 1200 | 2) | 8 |
| 6 | Al + Mg | 0.5 + 0.5 | 10 | 168 | 1800 | 360 | 9 |
| 7 | Al + Mg + Si | 0.5 + 0.5 + 1 | 10 | 168 | 1800 | 420 | 10 |

1) Coating too thin for micro-hardness testing.

2) Coating very brittle, micro-hardness testing is not correct.

The experiments show that adding kaolin to the powder mixture provides the expected effect within a wide range of zinc powder weight (from 1% to tens of percent). The theoretical required quantity for completely covering the samples surface is about 2.5 g of kaolin per one $m^2$, since the density of kaolin D is about 2.5 $g/cm^3$ and the lamella thickness t is about 1 μm. Hence, the theoretical required quantity Q covering an area S of 1 $m^2$ of parts is:

$$Q/S=D*t$$

or:

$$Q\ g/1\ m^2=2.5\ g/10^{-6}\ m^3*10^{-6}\ m=2.5\ g/m^2$$

Theoretically, the minimal quantity of zinc powder required for the diffusion coating having the thickness of 15 μm is about 100 $g/m^2$, but practically in the diffusion coating process, the required quantity is 2 to 5 times the theoretical one.

It should be emphasized that large quantities of kaolin in the powder mixture create a thick dust cover on the surface of the coated parts, which is very difficult to remove. On the other hand, large quantities of kaolin do not improve the coating process and the coating structure. Generally, the quantity of kaolin used in the process is from 0.1% to 3%, preferably from 0.1% to 1%, of the zinc quantity. The quantity of kaolin used, in the experiments, was 1% of the weight of the zinc powder.

A close look at Table 1 reveals that the method of the present invention successfully provides thin diffusion coatings on iron-base substrates with a wide range of chemical compositions and properties. The thickness of the coatings mainly depends on the various compositions of the powder mixtures as well as on the temperature of the vessel.

Table 1 shows that practically all the samples, regardless of the different compositions, have an excellent corrosion protection. The phosphatized samples, and especially those that were coated with 20 μm to 25 μm of epoxy cataphoretic e-coating (CDP), obtained excellent results in the neutral salt spray tests (SST) performed according to ASTM B 117-03, when the criterion for failure was determined as corroded substrate area exceeding 5% of the area of the sample.

It should be pointed here that in sharp contrast to these results, prior art thin diffusion coatings on iron-base substrates will corrode in the test in a very short time. This malfunction of prior art techniques results from the unprotected non-coated areas 2 surrounding coated "island" areas 1 (FIG. 1) formed in prior art coatings thinner than about 15 μm.

As shown in FIGS. 4 to 10, some of the components of the powder mixtures, such as silicon (FIG. 5) and iron (FIG. 8), do not significantly increase the coating thickness in comparison to sample 1 (FIG. 4) that included only zinc without any additional metal, while others, such as nickel (FIG. 6), tin (FIG. 7), aluminum and magnesium (FIGS. 9 and 10), significantly increase the thickness.

The temperature of the process, which is usually from 340° C. to 380° C., preferably 340° C., considerably influences the coating thickness. An increase of one centigrade during the process increases the coating thickness by 0.5 μm. to 1.5 μm; therefore, the coating thickness at 380° C. already reaches the range of Class 15 coatings. Accordingly, this novel diffusion coating method may be applied for obtaining a wide range of thick coatings, too, via alloying them with different chemical elements.

Zinc-base diffusion coatings containing aluminum and magnesium may have the greatest practical significance. Coatings containing these two metallic elements combine high hardness measured by Knoop Hardness units, also known as HK units, with good corrosion resistance, and can easily be an excellent alternative to normal (Sherardized) coatings. The chemical composition of this coating and the good corrosion protection are very similar to that of the commercial thick hot-dip coating known as ZAM®.

The microstructure of the ZAM® coating contains eutectic inclusions in zinc matrix, while this invented coating contains eutectic inclusions in zinc-iron intermetallic matrix, which has a corrosion resistance higher than pure zinc.

Another embodiment of the present invention, which is very similar to a known commercial product, is demonstrated in Experiment No. 7. In this experiment, the coating is a composite of zinc, aluminum, magnesium and silicon. This coating is similar in the chemical composition to the hot-dip thick Super Dyma coating.

The microstructure of the Super Dyma coating includes eutectic inclusions in the zinc matrix, while the inventive coating includes eutectic inclusions in the zinc-iron intermetallic matrix, and therefore a better corrosion resistance.

Table 2 compares the coating thickness measurements of Examples 1 and 6 determined by all the four thickness measurements methods mentioned hereinabove.

Contrary to the prior art techniques, and to the requirements of the Russian standard, the different thickness measurements were relatively close, which, in fact shows that the acquired diffusion coatings of the present invention are really substantially uniform, homogeneous and continuous.

TABLE 2

| # | Test | Measuring method | Thickness, μm |
|---|---|---|---|
| 1 | 1 | Magnetic gage | 6-8 |
| | | Metallographic | 6-7 |
| | | XRF | 4-5 |
| | | Pickling | 5 |
| 2 | 6 | Magnetic gage | 5-9 |
| | | Metallographic | 6-8 |
| | | XRF | 4-5 |
| | | Pickling | 5 |

As already referred to Class 1 of the standard, for example, dealing with a coating thickness of 6 μm to 9 μm. permits a coating thickness of 6 μm to 9 μm when measured by a magnetic gage and only 1.5 μm to 3 μm when measured by the XRF method. The difference between the thickness measured by a magnetic gage and the XRF, according to the Russian standard reaches 4.5 μm to 6 μm and the ratio between them is 3-4:1, while in the present invention the difference is only about 1 μm to 4 μm and the ratio is less than 2.5:1, and typically, 1.5-1.8:1.

As already explained before, the difference in measured thickness results from the fact that the coating has some un-coated areas 2. The magnetic method measures the thickness of "islands" 1 of the zinc diffusion coating, while the XRF method measures the average coating thickness on the tested area.

It should be stressed again, that this allowed difference between these two thickness measuring methods shows that prior art methods of zinc diffusion coatings still lack the knowledge of producing uniform and homogeneous coatings thinner than 15 μm.

The present invention is highly advantageous in providing a method of preparing and applying homogenous and thin polymetal diffusion coatings on iron-based materials, which give good corrosion protection to coated iron-based parts, have relatively uniform thickness, and serve as excellent base for additional coatings.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. A thin zinc diffusion coating, the diffusion coating comprising:

(a) an iron-based substrate;

(b) a uniformly thick zinc-iron intermetallic layer, received by diffusion of at least metallic zinc to said substrate, from a powder saturated environment, said zinc-iron intermetallic layer coating said iron-based substrate, said intermetallic layer having a first average thickness between 4 μm and 15 μm, as measured by a magnetic thickness gage;

said intermetallic layer having a second average thickness as measured by an X-Ray Fluorescence thickness measurement, and wherein a difference between said first average thickness and said second average is less than 4 μm.

2. The thin zinc diffusion coating of claim 1, wherein said intermetallic coating layer coats at least 98% of a surface of said iron-based substrate.

3. The thin zinc diffusion coating of claim 1, wherein individual thickness measurements of said intermetallic layer deviate from said average thickness by less than 20%.

4. A thin zinc diffusion coating, the diffusion coating comprising:

(a) an iron-based substrate;

(b) a uniformly zinc-iron intermetallic layer coating said iron-based substrate, received by diffusion of at least metallic zinc to said substrate, from a powder saturated environment said intermetallic layer having an average thickness between 4 μm and 15 μm as measured by a magnetic thickness gage and wherein individual thickness measurements of said intermetallic layer deviate from said average thickness by less than 20%.

5. The thin zinc diffusion coating of claim 4, wherein said zinc-iron intermetallic layer contains at least 60%, by weight, zinc.

6. The thin zinc diffusion coating of claim 5, wherein said zinc-iron intermetallic layer further includes an additional metal, other than zinc and iron, alloyed with said zinc.

7. The thin zinc diffusion coating of claim 6, wherein a composition of said zinc-iron intermetallic layer contains at least 0.2%, by weight, of said additional metal.

8. The thin zinc diffusion coating of claim 6, wherein a composition of said zinc-iron intermetallic layer contains at least 0.4%, by weight, of said additional metal.

* * * * *

UNITED STATES PATENT AND TRADEMARK OFFICE

CERTIFICATE OF CORRECTION

PATENT NO. : 8,398,788 B2
APPLICATION NO. : 12/524884
DATED : March 19, 2013
INVENTOR(S) : Avraham Sheinkman et al.

It is certified that error appears in the above-identified patent and that said Letters Patent is hereby corrected as shown below:

In the Claims

Column 15:

Claim 4, line 15 should be corrected as follows:
Change:

-- (b) a uniformly zinc-iron intermetallic layer coating said -- to

"(b) a uniformly thick zinc-iron intermetallic layer coating said"

Signed and Sealed this
Fourteenth Day of May, 2013

Teresa Stanek Rea
*Acting Director of the United States Patent and Trademark Office*